United States Patent [19]

Danek et al.

[11] 4,340,175

[45] Jul. 20, 1982

[54] MECHANICAL STRAW PENCIL

[76] Inventors: Ladislav Danek, c/o George Spector, 3615 Woolworth Bldg., 233 Broadway; George Spector, 3615 Woolworth Bldg., 233 Broadway, both of New York, N.Y. 10007

[21] Appl. No.: 141,044

[22] Filed: Apr. 17, 1980

[51] Int. Cl.[3] ..... A47G 21/18

[52] U.S. Cl. ..... 239/33; D7/42

[58] Field of Search ..... 215/1 A, 229; D7/42; 229/7 S; 239/16, 24, 33

[56] References Cited

U.S. PATENT DOCUMENTS 3,409,224 11/1968 Harp et al. ..... 239/33

FOREIGN PATENT DOCUMENTS 460131 10/1950 Italy ..... 239/33

*Primary Examiner*—Andres Kashnikow

[57] ABSTRACT

A permanently re-usable drinking straw that is telescoped for convenient carrying by a person, and including a tubular case from each opposite end of which a straw is outwardly slidable, one straw being slid inside the other, and in an extended position the straw ends being engaged so to form a continued and elongated straw assembly.

3 Claims, 6 Drawing Figures

MECHANICAL STRAW PENCIL

This invention relates generally to drinking straws.

A principal object of the present invention is to provide a permanently re-usable drinking straw for a personal use by an individual, and which is collapsible when not in use so that it can be conviently carried in a pocket or purse.

Another object is to provide a drinking straw in the appearance of a pencil-shaped holder that can be clipped to an edge of a pocket like a conventional pen or mechanical pencil.

Yet a further object is to provide a mechanical straw pencil shaped holder which can thus be always available to a person who is aware of the damage done to teeth by sweetened beverages, and who always prefers to drink the same through a straw so that the beverage does not contact the teeth when drawn into the mouth.

Figure 1:
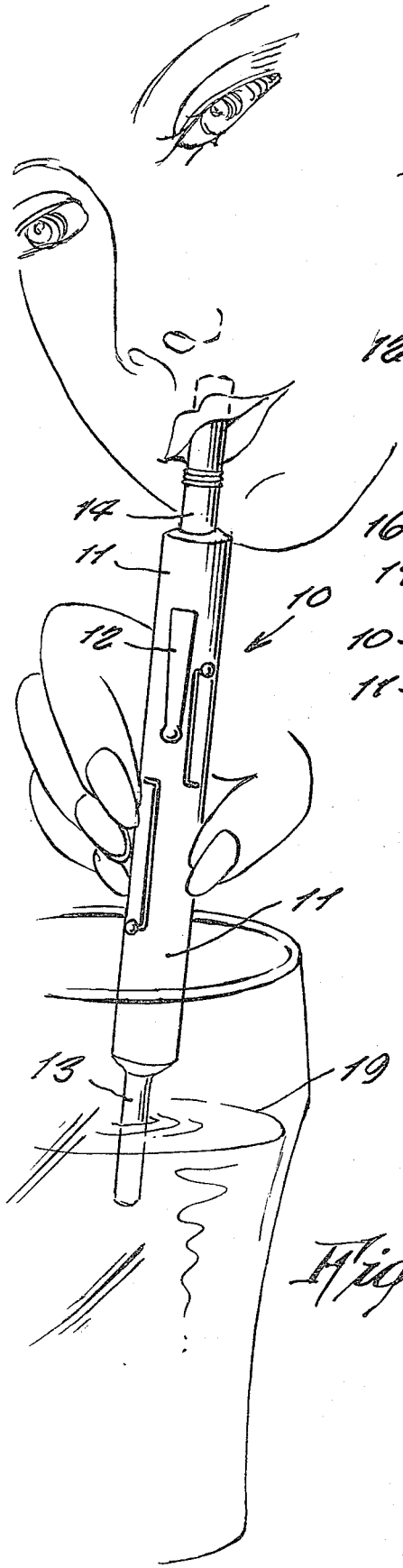
FIG. 1 is a perspective view of one design of the invention shown in use by being extended.
Figure 2:
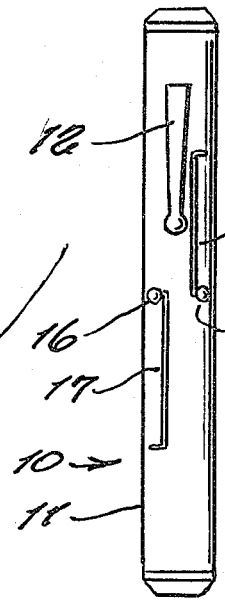
FIG. 2 is a side view thereof shown closed and retracted.

Referring now to the drawing in greater detail, and more particularly to FIGS. 1 through 4 thereof at this time, the reference numeral 10 represents a mechanical straw pencil shaped holder according to the present invention wherein there is a plastic tubular case 11 that resembles, in appearance, a conventional pen and which includes a clip 12 for clipping over an upper edge of a garment pocket.

Inside the case, two plastic straws 13 and 14 are contained, one straw 13 being smaller in diameter than the other and slide fitting therein. The straws are a same length and are shorter than the length of the case.

Figure 3:
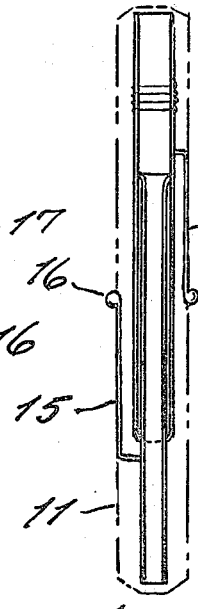
FIG. 3 is a cross sectional view thereof shown retracted.
Figure 4:
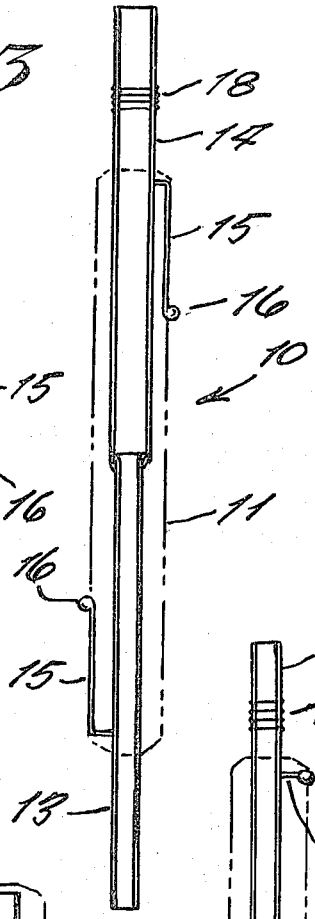
FIG. 4 is a cross sectional view thereof shown extended, such as in FIG. 1.

An arm 15 is attached to a side of each straw, and a knob 16 is on an outer end of each arm. Each arm is slidable in a slot 17 extending through a side wall of the case, and the knob is on an outer side of the slot, so that a person can push the knob along the slot between the slot opposite ends, thus causing the straws to be slided inwardly or outwardly of opposite ends of the case, as shown in FIGS. 3 and 4. The straws inner ends flare toward each other so that the straws cannot separate from each other when fully extended, as shown in FIG. 4. The upper straw includes a series of transverse pleats 18 so to permit the upper terminal end thereof to be tilted at an angle for comfortably reaching in a person's mouth.

The slot opposite ends extend a short length transversely so to retain the straws from freely sliding from either a retracted or extended positions.

In use, as shown in FIG. 1, both straws extend part way out of opposite ends of the case in order that a beverage 19 in a glass can be sucked therefrom into a person's mouth.

Figure 5:
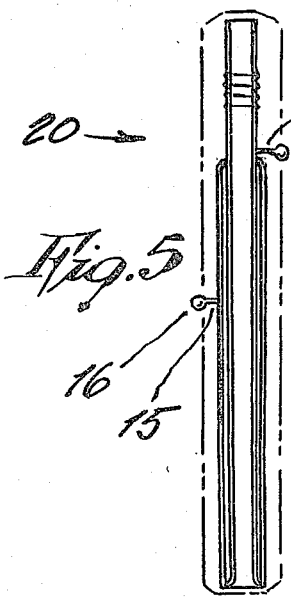
FIG. 5 is a cross sectional view of another design thereof which allows the straw lower end to be extendable a double distance downwardly so as to reach into a bottom of a taller glass or can.
Figure 6:
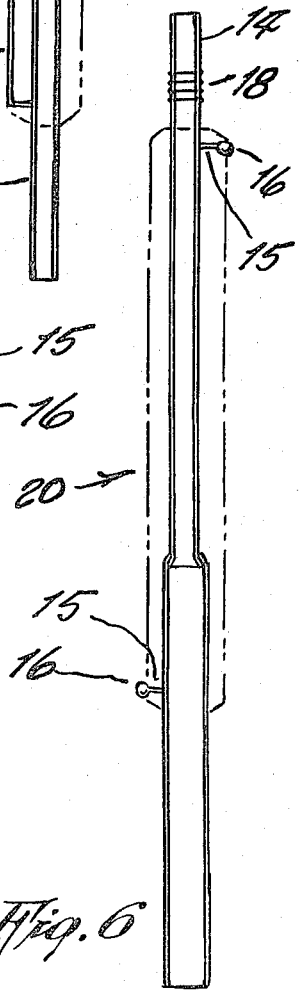
FIG. 6 is a similar view thereof showing the lower end extended farther than the design of FIGS. 1 to 4.

In FIGS. 5 and 6 a slightly modified design 20 of the invention is shown which allows the lower straw to be extended outwardly twice as far as in the design 10. This is accomplished even though the case is a same length as in the design 10. In this design, the upper straw is a full length of the case, and the arm 15 of each straw extends only straight sidewardly from the straw instead additionally extending also axially as in the design 10. Thus the knobs on the arms can be slided to practically an end of the case, so that the full length of the case is utilized for the sliding of the straws. Thus the lower straw can reach further down in a glass of beverage.

The case and straws can be molded in any attractive color of plastic so as to appeal to all persons.

What is claimed is:

1. A mechanical straw pencil shaped holder, comprising in combination, a tubular case open at each end, an extensible straw axially slidably mounted in said case said straw being outwardly slidable from said opposite ends of said case to provide a mouthpiece at one end and an inlet at the opposite end for insertion into liquid, including means for retaining the straw fully within the case when not in use and for retaining the straw in extended position.

2. A holder as in claim 1 wherein said means comprise transverse portions extending from said straw outward of apertures through said case said portions being movable axially along said apertures to transverse communicating slots for retention therein corresponding to the enclosed or extended positions.

3. A holder as in claim 2 wherein said straw comprises telescoped nested straws of smaller and larger diameter having coacting flared ends for retention in the extended position.

* * * * *